United States Patent [19]

Kenny et al.

[11] Patent Number: 4,566,423

[45] Date of Patent: Jan. 28, 1986

[54] ELECTRONIC FEEDBACK EGR VALVE

[75] Inventors: Andrew A. Kenny, Roselle; Robert G. Sokalski, Wheaton; Lawrence E. Egle, Itasca; Daniel C. Stahly, Elmhurst, all of Ill.

[73] Assignee: Eaton Corporation, Cleveland, Ohio

[21] Appl. No.: 563,474

[22] Filed: Dec. 20, 1983

[51] Int. Cl.[4] ..... F02M 25/06

[52] U.S. Cl. ..... 123/571; 137/907; 251/61.5

[58] Field of Search ..... 123/568, 571; 137/487.5, DIG. 8; 251/61.5

[56] References Cited

U.S. PATENT DOCUMENTS

| | | | |
|---|---|---|---|
| 895,426 | 8/1908 | Cable | 137/487.5 |
| 4,142,495 | 3/1979 | Lahiff | 123/571 |
| 4,290,404 | 9/1981 | Hata et al. | 123/571 |
| 4,318,385 | 3/1982 | Yamaguchi | 123/571 |
| 4,399,798 | 8/1983 | Stoltman | 123/571 |

*Primary Examiner*—Craig R. Feinberg
*Assistant Examiner*—W. R. Wolfe
*Attorney, Agent, or Firm*—C. H. Grace; R. A. Johnston

[57] ABSTRACT

A vacuum operated EGR valve/controller having a vacuum signal responsive diaphragm converted to operate the EGR poppet valve. A flow limiting orifice is provided upstream of the valve and a flow sensing pressure tap provided intermediate the valve and the orifice. Flow pressure is sensed by a piezoresistive transducer which gives an electrical signal indicative thereof. In one embodiment, the transducer is stationary and flow sensing tube is extended to the valve body. In a second embodiment, the transducer is mounted on the diaphragm for movement therewith and flow sensing is internal through the valve actuator. In another embodiment, a flow sensing orifice is provided downstream of the valve and the transducers has a reference and dynamic probe for sensing the differential of flow pressure on opposite sides of the sensing orifice. In another embodiment, plates attached to the diaphragm form a flow pressure sensing chamber and the transducer tube is received through the plate rail and is sealed by a flexible seal.

3 Claims, 6 Drawing Figures

ELECTRONIC FEEDBACK EGR VALVE

BACKGROUND OF THE INVENTION

The present invention relates to devices and systems for controlling the recirculation of exhaust gas (EGR) in an internal combustion engine for controlling exhaust emissions from the engine. Heretofore, such devices have employed a source of engine generated vacuum applied to pressure responsive means for operating a moveable valve for controlling flow of the exhaust gas in a recirculation passage. Typically, the control passage is connected between the engine exhaust manifold and the induction passage or intake manifold. It is also known to employ in such control devices, means for sensing exhaust gas pressure upstream of the valve member for use in modifying the effects of the vacuum as applied to the pressure responsive member for moving the control valve member.

The aforesaid EGR control devices have been generally self-contained and operate independently of other engine control devices. However, it has recently been found desireable to operate electrically actuated control devices for varying the supply of fuel to the engine and for varying control of the ignition spark in non-compression ignition engines. Where the fuel metering and/or ignition spark time are electrically controlled, it has been found desireable to employ solid state electronic controllers such as microprocessors for providing the control signals to the electric actuators which in turn vary the spark timing and fuel metering. Where such electrical engine operation control is employed, it has been found necessary to take into account the amount of exhaust gas recirculation as well as other engine parameters such as coolant temperature, RPM and engine charge mass flow. Where these latter engine parameters are monitored for the purposes of generating an electrical control signal, it will be recognized that electrical sensors or transducers are required to provide the desired sensory input to the microprocessor for operational control.

Referring to FIG. 4, a known EGR controller 12 is shown as having an exhaust gas passage inlet orifice 1, and exhaust gas passage outlet 2 with intermediate valve seat 3 and moveable valve member 4 for controlling flow between inlet and outlet. Hollows actuating rod 5 connects the valve 4 to a pressure responsive diaphragm 9 which moves in response to a vacuum signal applied to connector tube 28. Bellows 7 creates pressure chamber 6 which communicates through hollow rod 5 with the passage pressure upstream of the valve seat. Pressure transducer 8 senses pressure in bellows chamber 6, which is representative of dynamic flow pressure in the inlet passage, and the transducer 8 emits an electrical signal through leads 24, 26 which is indicative of the sensed flow pressure. The aforesaid known EGR controller has disadvantage of relying on the integrity of the resilient bellows material in withstanding the punishment of flexing while exposed to hot exhaust gas.

It has thus been desired to find improved means of providing engine EGR responsive to an electrical signal available from an on-board microprocessor employed for engine control, it has thus been desired to employ an electrical signal for control of a modulator valve for providing the vacuum control signal to the EGR controller and to provide such a device without relying on the integrity of a resilient flexing bellows exposed to hot exhaust gas.

SUMMARY OF THE INVENTION

The present invention provides an EGR control device whereby the EGR flow rate is sensed, along with other sensed engine parameters, and an electrical control signal is provided for controlling a fluid pressure modulator valve to provide a vacuum signal to control movement of the EGR flow control valve. The control device of the present invention employs a vacuum responsive diaphragm operably connected to move a control valve member for controlling recirculation of exhaust gas in a control passage.

The present device has an orifice provided in the control passage upstream of the control valve and the pressure is sensed in the passage between the orifice and the control valve by an electrical transducer which provides an electrical signal having certain characteristics thereof indicative of the EGR flow rate in the control passage. The upstream orifice is flow limiting and the pressure transducer thus senses the dynamic pressure in the control passage due to EGR flow. The output of the electrical transducer is employed in a signal processor which provides an electrical control signal to the modulator valve for controlling the vacuum signal to the control valve diaphragm.

In one embodiment of the invention an auxiliary sensing orifice is provided downstream of the control valve and the electrical pressure transducer senses the pressure differential on opposite sides of the downstream orifice for detecting the pressure differential across the orifice to thus provide a signal indicative of the flow therethrough.

In another embodiment of the invention the pressure transducer is mounted for movement with the valve control diaphragm. In still another embodiment of the invention the transducer is disposed on the control device body in a stationary manner and an external sensing tube connects the transducer sensing port to the region upstream of the valve seat. The pressure transducer in the preferred practice comprises a piezo-resistive device.

The present invention thus provides a unique device for controlling the EGR flow in an engine whereby EGR flow pressure is sensed and an electrical signal provided which is processed and applied to an electrically controlled modulator valve which in turn provides a fluid pressure control signal for controlling the position of the EGR control valve.

DETAILED DESCRIPTION

Figure 1:
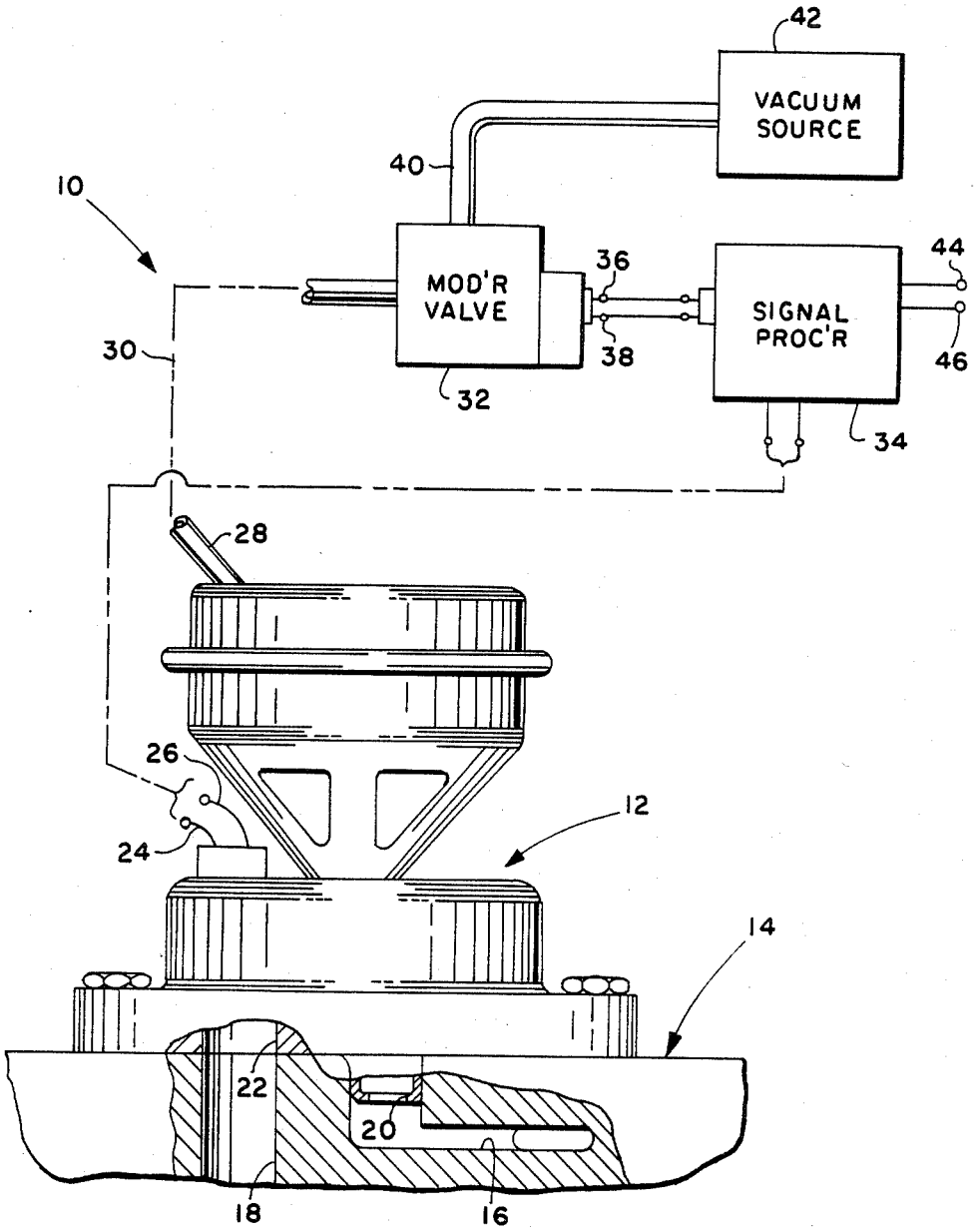
FIG. 1 is a pictorial schematic of the control system of the present invention as installed on the intake manifold structure of an internal combusion engine.

Referring now to FIG. 1, the control system indicated generally at 10 is illustrated as having an EGR controller, indicated generally at 12, secured to the manifold of an engine indicated generally at 14.

Manifold 14 has an exhaust gas passage 16 connected to the exhaust of the engine and an exhaust gas recirculation passage 18 connected to the cylinder intake passages of the engine.

The controller 12 has an upstream orifice 20 provided at the inlet thereof for receiving exhaust gas from passage 16 in the engine manifold, and an EGR outlet 22 which communicates with the induction passage 18 in the engine manifold.

The controller 12 has a pair of electrical output leads 24, 26 and a vacuum signal input connector 28 which is connected via conduit 30 to the outlet of an electrically operated vacuum modulator valve 32. Electrical leads 24, 26 are connected to a set of input terminals of signal processor 34 which has the output thereof connected to input terminals 36, 38 of the modulator valve 32. The modulator valve 32 receives a source of subatmospheric air pressure via conduit 40 from a suitable onboard vacuum source 42 as for example, a vacuum pump or tap to the engine intake manifold. The signal processor is powered from an onboard electrical supply (not shown) connected to terminals 44, 46.

The system interconnections described above to the controller 12 are shown for purposes of understanding the invention and known in the art and thus comprise no part of the present invention.

Figure 2:
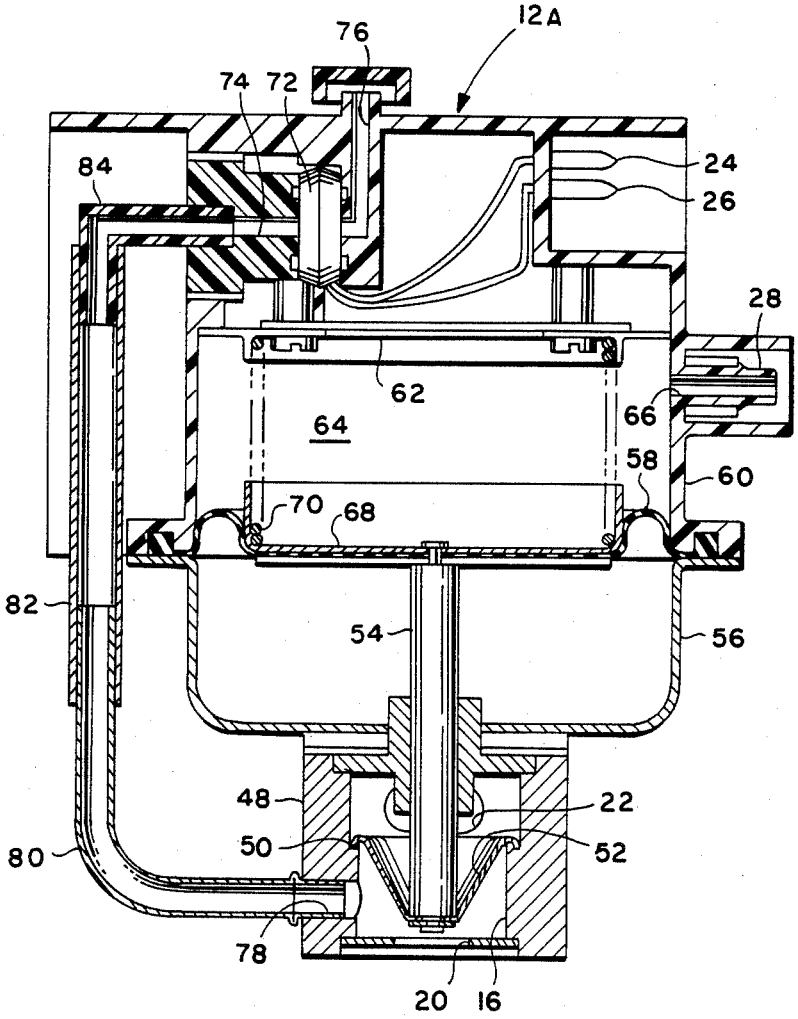
FIG. 2 is a cross-sectional view of the embodiment of the EGR controller.

Referring now to FIG. 2, one embodiment of the invention is shown as embodied in a valve controller indicated generally at 12A as having an inlet passage 16 flow limiting orifice 20 and an exhaust outlet passage 22 formed in a body member 48. A valve seat 50 is provided in the passage 16 and is disposed intermediate the inlet orifice 20 and the outlet passage 22 and has a moveable valve member 52 shown in FIG. 2 in contact therewith for controlling flow through passage 16 to outlet 22.

An actuator means comprising a rod 54 has one end thereof connected to valve member 52 and the rod extends upwardly through the body 48 and into the interior of housing member 56 attached to the body 48.

A pressure responsive diaphragm 58 has the outer periphery thereof sealed between the rim of housing member 56 and the rim of upper housing member 60 and cooperates with a wall portion 62 provided in the upper housing 60 for defining therebetween a vacuum signal chamber 64. A vacuum port 66 is provided into chamber 64 and a suitable connector 28 is provided for connection to the vacuum conduit 30 (see FIG. 1). The rod 54 is connected to a suitable backing plate 68 provided on diaphragm 58 in the central region thereof; and, rod 54 is biased downwardly by a spring 70 acting against the plate 68 for biasing the valve member 52 into contact with seat 50.

A piezoresitive pressure transducer 72 is mounted on the upper body portion 60 above wall 62 and has a pressure sensing port 74 and an atmospheric vent or reference port 76 provided therefor. In the presently preferred practice of the invention, the transducer comprises a commercially available device obtained from Motorola Semiconductor Products, Inc. Automotive and Industrial Electronics Group, 1299 East Algonquin road, Schaumberg, Ill. 60196 having manufacturers' designation P/N MDX-50.

A suitable pressure port or tap 78 is provided in the body member 48 intermediate the flow limiting orifice 20 and valve seat 50. A conduit comprising tubing 80, flexible hose 82 and tubing 84 interconnects the pressure sensing port 74 of the transducer with the pressure tap 78.

In the operation of a controller 12A, a vacuum signal applied through port 66 causes diaphragm 58 to lift actuator rod 54 and open valve member 52 permitting exhaust gas to flow from inlet 16 to outlet 22. The dynamic pressure in passage 16 is sensed through port 78 by the transducer 72 and an electrical signal is provided through terminals 24, 26 to the signal processor. Changes in the position of valve 52 with respect to valve seat 50 will be detected by changes in the sensed pressure at port 78 and transducer 72 will thus provide an altered electrical signal in response to such changes. The embodiment of the controller 12A thus enables the pressure transducer to be located remotely from the body member 48 which exposed to hot exhaust gases and the transducer is protected therefrom. Furthermore, the external arrangement of conduit 80 from pressure tap 78 and the flexible hose 82 extending exteriorly of the body of the controller 12A provides for air circulation around conduit 80 and cooling thereof. In addition, this arrangement provides thermal isolation of the transducer sensing port 74 from the heated conduit 80 by means of the intermediate hose 82.

Figure 3:
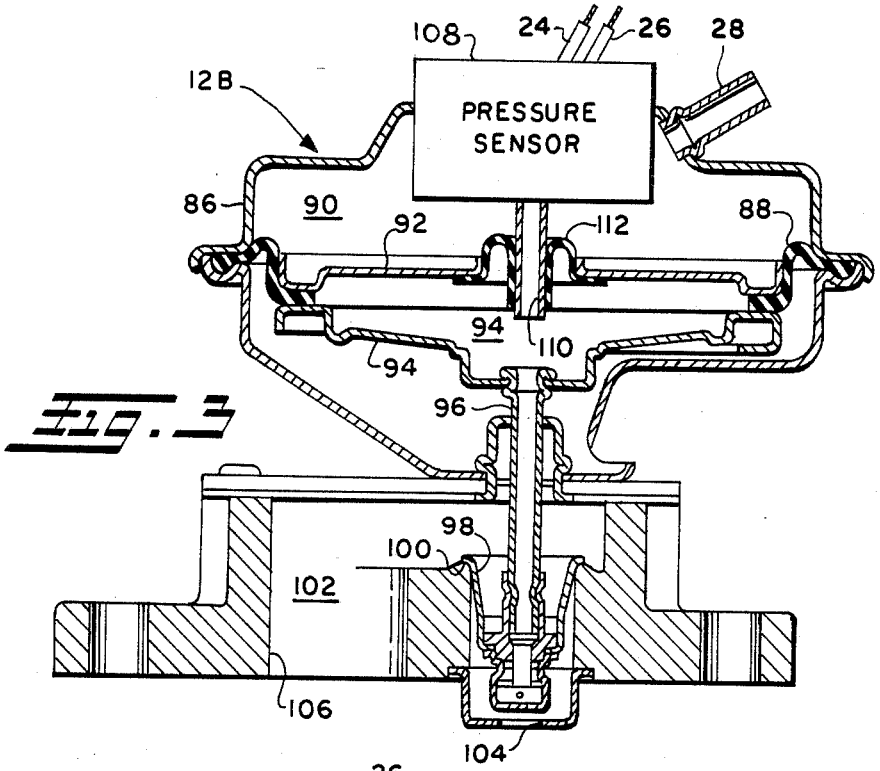
FIG. 3 is a view similar to FIG. 2 illustrating another embodiment of the EGR controller.
Figure 4:
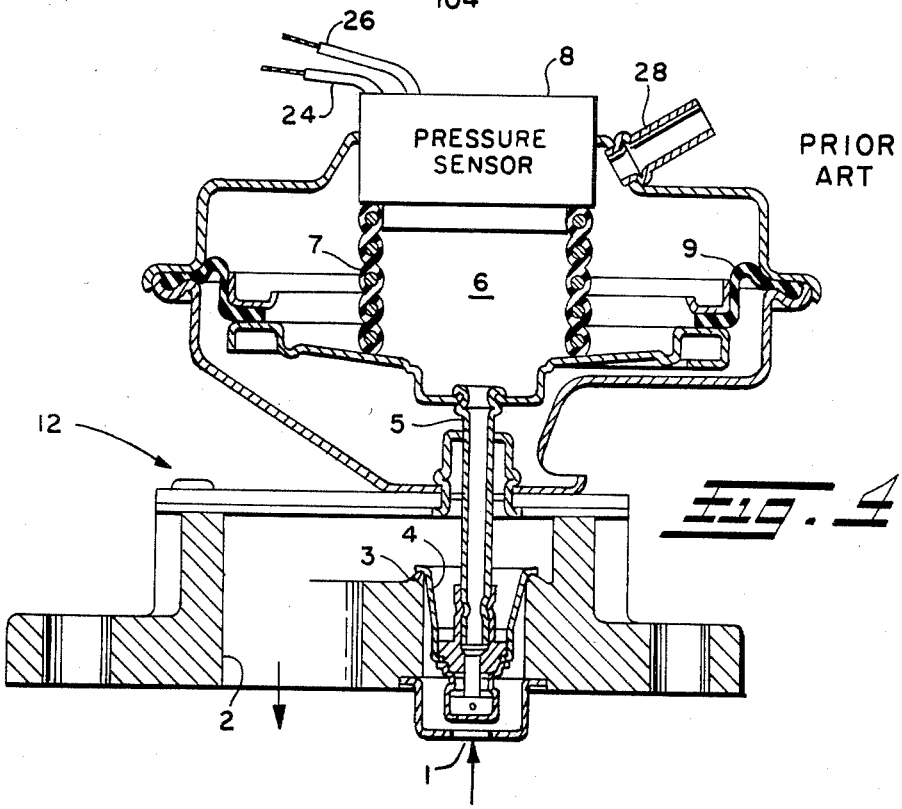
FIG. 4 is a view similar to FIG. 2 and illustrates a known EGR controller.

Referring now to FIG. 3, another embodiment of the invention is shown wherein the controller, indicated generally at 12B, comprises an improvement over the prior art controller shown in FIG. 4. The controller 12B of FIG. 3 has a housing 86 having a diaphragm 88 disposed therein and sealed about the periphery thereof to define therein a vacuum control signal 90.

Diaphragm 88 has an upper and lower plate 92, 94 attached centrally thereto, which plates form therebetween a positive pressure signal chamber 94. A suitable vacuum connector 28 is provided through housing 86 for communicating with the vacuum chamber 90. The lower diaphragm plate 94 is connected to hollow actuator rod 96 which is operatively connected to a moveable EGR valve member 98 which is moveable with respect to valve seat 100 disposed in EGR passage 102 intermediate inlet orifice 104 and discharge outlet 106. The hollow actuator communicates the pressure in the passage intermediate orifice 104 and valve seat 100 to the pressure chamber 94.

An electrical piezoresitive transducer 108 is disposed on the upper portion of housing 86 and the transducer has electrical connectors 24, 26 provided thereon and has a fluid pressure sensing tube with port 110 therein extending downwardly therefrom through an aperature provided centrally in upper backing plate 92 for communicating the pressure in chamber 94 to the transducer 108.

A flexible seal 112 is provided about the pressure sensing port 110 and has a periphery thereof sealed on upper back plate 92. The arrangement of the transducer 12B in FIG. 3 thus permits vertical movement of the plate 92, in response to pressure changes in chamber 90, without disturbing the pressure sensing port 110 of the pressure transducer to thereby maintain communication between the sensing port 110 and the pressure in chamber 94.

In operation as diaphragm 88 moves in response to change in pressure in chamber 90, plate 94, which is attached to the diaphragm 88, causes movement of actuator rod 96 for opening valve 98 and permitting EGR flow through passage 102. The pressure in the region between orifice 104 and valve seat 100 is sensed through hollow tube 96 and chamber 94 by the pressure transducer 108 which provides an electrical signal at connectors 24, 26 indicative of the pressure changes upstream of the valve member 98. The embodiment of FIG. 3 thus provides a convenient way of mounting the pressure transducer 108 in stationary attachment to the housing and yet provides communication of the transducer sensing port to the pressure chamber 94 moving with the diaphragm.

Figure 5:
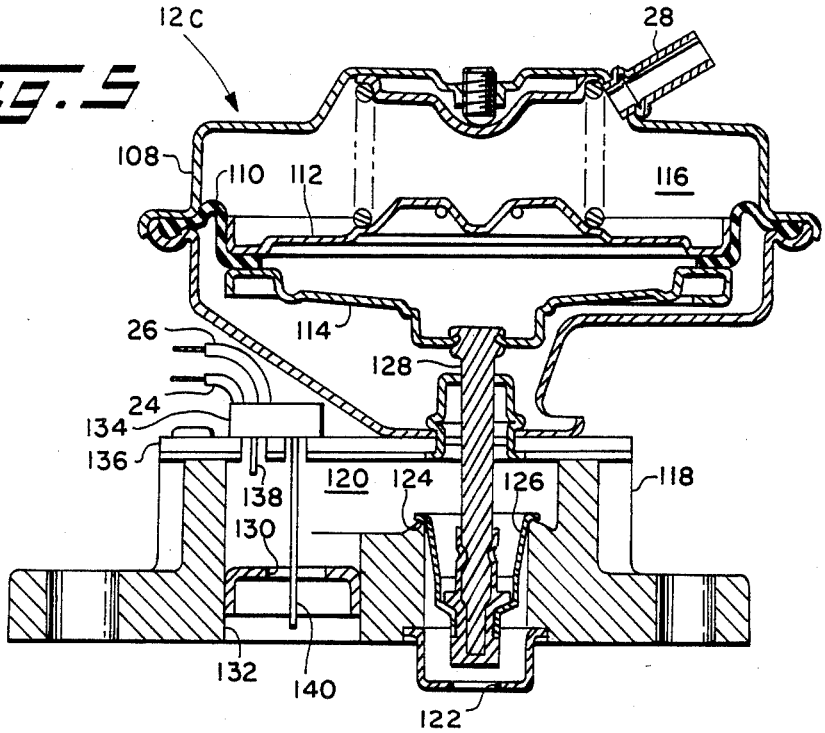
FIG. 5 is a view similar to FIG. 2 illustrating another embodiment of the invention employing a downstream sensing orifice; and, FIG. 6 is a view similar to FIG. 2 illustrating an embodiment of the EGR controller having the pressure transducer moveable with the control diaphragm.

Referring now to FIG. 5, another embodiment of the invention is shown as comprising a controller indicated generally at 12C, with a housing 108 having received therein a flexible diaphragm 110 sealed to the housing about the periphery thereof. An upper and lower plate means comprising upper and lower plates 112, 114 are attached to the diaphragm for movement therewith. The space between the housing 108, diaphragm 110 and plate 112 comprises a vacuum chamber 116 ported through connector 28 for receiving a suitable vacuum control signal therein. The housing 108 is attached to a block 118 which defines therein EGR passage 120 having an inlet orifice 122 and valve seat 124 downstream thereof. A moveable valve member 126 is received in the passage 120 and is operatively connected for movement by rod 128 to the lower diaphragm 114 for effecting movement of the valve member 126 with respect to seat 124. A downstream measuring orifice 130 is provided in the passage 120 adjacent the outlet 132 thereof.

A piezoresistive pressure transducer 134 is attached to a suitable insulator plate 136 provided on the upper portion of block 118 and the transducer has a reference port probe 138 extending through the insulator into passage 120 on the upstream side of orifice 130. The transducer 134 has a dynamic sensing probe 140 which extends through the measuring orifice 130 to the output of region 132 of the EGR passage downstream of the orifice 130. Transducer 134 thus senses the pressure differential caused by EGR flow through orifice 130 when valve 126 is in the open position. Transducer 134 has connectors 24, 26 extending therefrom for connection to the input terminals of the signal processor 34 as shown in FIG. 1.

In operation, upon application of a vacuum control signal to connector 28, a vacuum is formed in chamber 116 causing a diaphragm to lift rod 128 and open valve 126 by an amount responsive to the vacuum signal pressure for controlling flow through passage 120.

Figure 6:
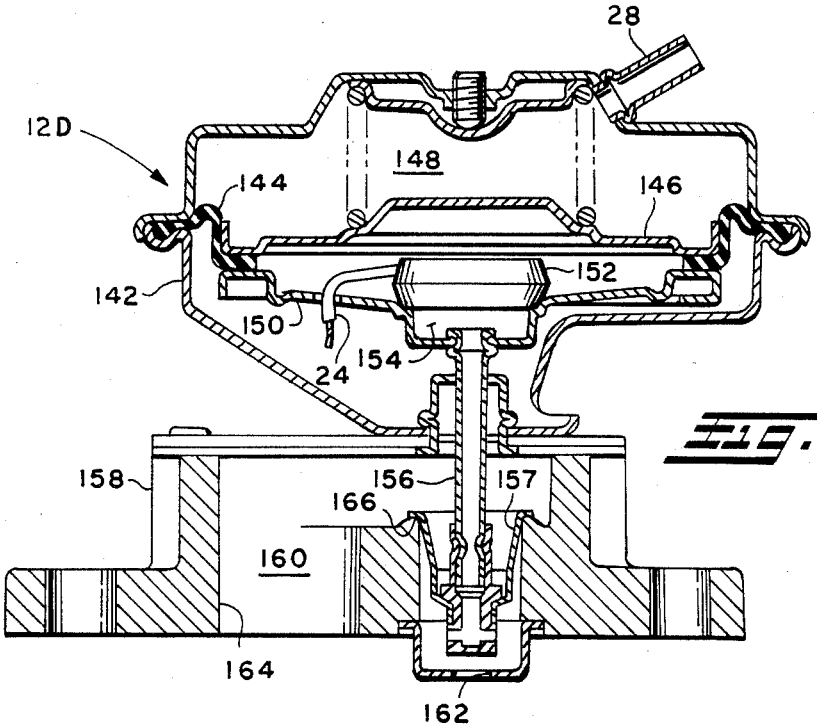

Referring now to FIG. 6, another embodiment of the invention is shown wherein the EGR valve controller indicated generally at 12D has a housing 142 having a flexible diaphragm 144 disposed therein and sealed about the periphery thereof with a plate 146 attached to the central region of the diaphragm. The diaphragm and plate 146 thus define a vacuum signal chamber 148 within the housing, which chamber is ported through connector 28 for attachment to a source of vacuum control signal. A second plate 150 is attached to the underside of the diaphragm in the central region thereof and has received thereon a piezoresistive pressure transducer 152. The plate 150 is configured in the central portion thereof to define a positive pressure chamber 154 which is in communication with the sensing surface or port of the transducer 152. The transducer has electrical connections such as connector 24 extending therefrom for attachment to a signal processor such as processor 34 as shown in FIG. 1.

Plate 150 is connected to a hollow rod 156 which extends through the wall of a block 158 attached to the housing 142. Block 158 defines an EGR passage 160 having a flow limiting inlet orifice 162 and discharge outlet 164. A valve seat 166 is disposed intermediate the inlet orifice 162 and outlet 164 and the valve seat has received thereagainst a moveable valve member 168 connected to the lower end of rod 156 for movement therewith with respect to the valve seat 166.

In operation, the valve controller 12D of FIG. 6 responds to a vacuum control signal through connector 28 where upon diaphragm 144 lifts plate 150 and rod 156 to open valve member 157 with respect to the valve seat for permitting EGR flow through orifice 162 passage 160 and for discharge to outlet 164. The pressure chamber 154 is pressurized by exhaust gas in the region intermediate valve seat 166 and inlet orifice 162 flowing upwardly through the hollow rod 156 for sensing by the transducer 152. As the valve position is changes with respect to valve seat 166 by movement of a rod 156, the changes in pressure in the region between the valve seat and inlet orifice 162 are sensed by the pressure transducer 152 with emits an electrical signal having certain characteristics thereof indicative of the pressure changes.

The present invention provides a unique EGR valve controller which emitts an electrical signal indicative of the changes in pressure in the EGR flow passage effected by movement of a control valve member disposed therein. The present invention provides in the various illustrated embodiments, the novel construction for such an EGR valve controller employing a piezoresistive pressure transducer which senses the pressure differential between the dynamic pressure in the EGR flow passage and the ambient static pressure. Alternatively, the pressure transducer is arranged to sense the pressure differential existing across a measuring orifice disposed in the passage downstream of the control valve.

Although the invention has been described in the presently preferred practice with respect to the illustrated embodiments, it will be understood by those skilled in the art that modifications and variations to the invention may be made; and, the invention is limited only by the following claims:

We claim:

1. An improved EGR valve controller comprising:

(a) body means defining an exhaust gas recirculation passage having an inlet, an outlet and a valve seat disposed in said passage intermediate said inlet and said outlet;

(b) a valve member disposed in said EGR passage, said valve member moveable with respect to said valve seat for controlling flow through said passage;

(c) pressure responsive means defining in cooperation with said body means a vacuum signal chamber;

(d) means defining a vacuum connector having a port communicating with said vacuum signal chamber, said connector adapted for connection to a vacuum source;

(e) actuator means operatively interconnecting said pressure responsive means and said valve member for effecting movement of the latter in response to pressure changes in said vacuum chamber;

(f) means defining an EGR flow limiting orifice in said EGR passage upstream of said valve seat;

(g) means defining a pressure tap in said EGR passage intermediate said valve seat and said flow limiting orifice;

(h) pressure transducer means having a sensing port and mounted on said body means remote from said EGR passage with said sensing port vertically at a level above said pressure tap when said controller is installed on an engine;

(i) conduit means extending externally of said body means and interconnecting said pressure tap and said transducer sensing port said conduit means including a section thereof disposed externally of said body means and operative to thermally isolate said transducer port from said pressure top, wherein said transducer means is operative to emit an electrical signal having certain characteristics thereof indicative of the pressure sensed in said tap.

2. The controller defined in claim 1, wherein said thermally isolating means includes a flexible hose.

3. The controller defined in claim 1, wherein said transducer comprises a piezo-resistive device.

* * * * *